US005395185A

United States Patent [19]

Schnabel, Jr.

[11] Patent Number: 5,395,185

[45] Date of Patent: Mar. 7, 1995

[54] METHOD OF TEMPORARILY SHORING AND PERMANENTLY FACING AND EXCAVATED SLOPE WITH A RETAINING WALL

[75] Inventor: Harry Schnabel, Jr., Bethesda, Md.

[73] Assignee: Schnabel Foundation Company, Sterling, Va.

[21] Appl. No.: 155,231

[22] Filed: Nov. 22, 1993

[51] Int. Cl.[6] ..... E02D 29/00

[52] U.S. Cl. ..... 405/287; 405/262; 405/284

[58] Field of Search ..... 405/262, 258, 284, 285, 405/286, 287, 272, 273

[56] References Cited

U.S. PATENT DOCUMENTS

| | | |
|---|---|---|
| Re. 28,977 | 9/1976 | Mason . |
| 1,270,659 | 6/1918 | Ravier . |
| 1,739,108 | 12/1929 | Weber . |
| 1,747,038 | 2/1930 | Weber . |
| 1,761,614 | 6/1930 | Collier . |
| 1,762,343 | 6/1930 | Munster . |
| 1,909,980 | 5/1933 | Newman . |
| 1,933,483 | 10/1933 | Pennoyer . |
| 2,000,492 | 5/1935 | McKeen . |
| 2,045,112 | 6/1936 | Upson . |
| 2,110,253 | 3/1938 | Nedden . |
| 3,198,614 | 8/1965 | Powell . |
| 3,226,933 | 1/1966 | White . |
| 3,243,963 | 4/1966 | Schnabel, Jr. . |
| 3,250,075 | 5/1966 | Webb et al. . |
| 3,412,562 | 11/1968 | Doughty . |
| 3,438,207 | 4/1969 | Turzillo . |
| 3,464,211 | 9/1969 | Andresen . |
| 3,490,242 | 1/1970 | Schnabel, Jr. . |
| 3,530,676 | 9/1970 | York . |
| 3,541,798 | 11/1970 | Schnabel, Jr. . |
| 3,555,830 | 1/1971 | York . |

(List continued on next page.)

FOREIGN PATENT DOCUMENTS

| | | |
|---|---|---|
| 2233857 | 2/1975 | France . |
| 2917994 | 10/1980 | Germany . |
| 2102866 | 2/1983 | United Kingdom . |

OTHER PUBLICATIONS

C. Louis, "New Support Method for Cut Slopes", Revue Travaux, Mar. 1981, pp. 67–75.

C. Louis, "Latest Developments in Soil Nailing", 1985.

"Soil and Rock Anchors", VSL Corporation Brochure, p. 9, Apr. 1978.

VSL Newsletter, p. 11, Nov. 1982.

*Primary Examiner*—Dennis L. Taylor

*Attorney, Agent, or Firm*—Banner, Birch, McKie & Beckett

[57] ABSTRACT

A method of temporarily shoring and permanently facing an excavated slope or embankment is provided. First, a slope is excavated in successive sections from the top down to form exposed slope faces. A temporary shoring wall is then formed by shoring up the exposed slope face of each successively excavated section with soil nails and at least one layer of pneumatically applied concrete. As the desired final depth of the excavation is reached, the tiebacks are installed. The pneumatically applied concrete is thickened in the area of the tiebacks so as to form reinforcement elements along the exposed slope faces. The reinforcement elements include reinforced steel bars which extend outwardly away from the exposed slope faces. The tie backs are tested, prestressed and secured against the reinforcement elements. Finally, a final retaining wall is formed by pouring and curing a layer of reinforced concrete over the temporary shoring wall and the secured tiebacks.

14 Claims, 5 Drawing Sheets

U.S. PATENT DOCUMENTS

| | | | |
|---|---|---|---|
| 3,638,435 | 2/1972 | Mason . | |
| 3,802,204 | 4/1974 | Mason . | |
| 3,807,182 | 4/1974 | Schnabel, Jr. . | |
| 3,922,864 | 12/1975 | Hilfiker . | |
| 3,999,391 | 12/1976 | Meredith . | |
| 3,999,392 | 12/1976 | Fukushima et al. . | |
| 3,999,398 | 12/1976 | Kurose . | |
| 4,055,927 | 11/1977 | Tamaro | 52/577 |
| 4,106,225 | 8/1978 | Schnabel, Jr. | 37/184 |
| 4,117,686 | 10/1978 | Hilfiker | 405/284 |
| 4,124,983 | 11/1978 | Weatherby | 405/260 |
| 4,242,013 | 12/1980 | Watts | 405/272 |
| 4,318,637 | 3/1982 | Oger et al. | 405/153 |
| 4,343,572 | 8/1982 | Hilfiker | 405/284 |
| 4,369,004 | 1/1983 | Weatherby | 405/262 |
| 4,391,557 | 7/1983 | Hilfiker et al. | 405/287 |
| 4,407,611 | 10/1983 | Murray et al. | 405/284 |
| 4,426,176 | 1/1984 | Terada | 405/285 |
| 4,448,571 | 5/1994 | Eckels | 405/284 |
| 4,449,857 | 5/1984 | Davis | 405/286 |
| 4,470,728 | 9/1984 | Broadbent | 405/284 |
| 4,480,945 | 11/1984 | Schnabel, Jr. | 405/262 |
| 4,505,621 | 3/1985 | Hilfiker et al. | 405/284 |
| 4,514,113 | 4/1985 | Neumann | 405/286 |
| 4,561,804 | 12/1985 | Weatherby | 405/262 |
| 4,564,316 | 1/1986 | Hunziker | 405/262 |
| 4,718,791 | 1/1988 | Weatherby | 405/262 |
| 4,718,792 | 1/1988 | Louis | 405/262 |
| 4,732,510 | 3/1988 | Louis | 405/269 |
| 4,911,582 | 3/1990 | Peirce, Jr. et al. | 405/262 |
| 4,911,583 | 3/1990 | Carey | 405/262 |
| 5,002,436 | 3/1991 | Sigourney | 405/262 |

METHOD OF TEMPORARILY SHORING AND PERMANENTLY FACING AND EXCAVATED SLOPE WITH A RETAINING WALL

BACKGROUND OF THE INVENTION

1. Field of the Invention

The present invention is dirty to a method of temporarily shoring and permanently facing an excavated slope with a reining wall. The method is particularly adapted for use with slopes or embankments formed alongside a roadway beneath a highway bridge. It is often necessary to re-excavate the slopes or embankments beneath a bridge when the roadway surface running beneath the bridge is widened.

2. Description of the Prior Art

Tied Back Walls

One method of supporting the sides of excavations made in soil is to use tied back walls. Each tieback comprises a grouted anchor installed in the soil mass to secure a tendon which applies a force on the reining wall. The tiebacks are anchored in the ground and apply the force necessary to support the soil mass. The force necessary to support the side of an excavation is applied to the tieback by testing and prestressing it against pilings disposed vertically in the soil mass. These vertically disposed pilings are commonly known as soldier beams. This method consists of the following steps:

installing a plurality of soldier beams into the soil mass in the area of the retaining wall to be formed;

excavating a soil wall from the top down in successive sections;

applying wood lagging between the soldier beams, or alternatively pneumatically applied concrete, to help support the exposed face of the soil;

installing tiebacks into the soil mass;

testing and prestressing the tiebacks against the soldier beams;

repeating the above steps as needed; and pouring a final outer layer of concrete over the pilings, lagging and tiebacks to form a permanent tied back wall.

U.S. Pat. No. 4,561,804 shows one type of tied back wall. The exposed face of the soil wall is supported in part by vertically disposed sheet piles and either timber lagging or a layer of pneumatically applied concrete. The soil is then removed in descending stages until further support becomes necessary. At this point, tiebacks are installed through the sheet piles and into the soil mass. The tiebacks are then secured, tested and prestressed against the sheet piles. Excavation continues to the subgrade while lagging and, if required, more tiebacks are installed. A final layer of poured concrete is provided to form the finished, permanent retaining wall.

As shown in U.S. Pat. No. 4,561,804, vertically disposed sheet piles are driven into the soil mass to support the soil wall in a tied back wall system. While this construction method may be effective for newly constructed embankments in open areas, it is entirely inapplicable to a slope which is located beneath an existing bridge span. The installation of vertical piling is not desirable in this application because the bridge structure is disposed directly above the embankment. Thus, piling cannot be driven into the slope without demolishing portions of the existing bridge structure.

Soil Nail Walls

Soil nailing is another method which is used to retain a soil wall formed adjacent to an excavated slope. Soil nailing is often preferred over the above-mentioned tied back walls because sheet piles and timber lagging are not required and the technique is thus less costly. An array of nearly horizontal reinforcement rods (soil nails) are installed in the soil mass as the excavation proceeds downwardly. A reinforced layer of pneumatically applied concrete is used to support the exposed face between the soil nails. This method consists of the following steps:

excavating a soil wall from the top down in successive sections;

applying a layer or layers of pneumatically applied concrete to help support the exposed face;

installing a row of soil nails through the pneumatically applied concrete layer or layers and into the soil mass; and repeating the above steps as needed.

U.S. Pat. Nos. 3,638,435; 3,802,204 and Re. 28,977 are exemplary of such a soil nail system. Two layers of pneumatically applied concrete are used to form an outer skin for an exposed slope wall. Boreholes extend through the skin and into the ground adjacent the wall. The boreholes are filled with grout to form a dowel, and a reinforcing rod (soil nail) is then installed in the hole before the grout sets. One end of the rod (soil nail) extends outwardly from the skin to facilitate securing the dowel to the outer wall. In one embodiment, the rod (soil nail) is secured to the shotcrete skin itself via a beating plate and fastener. In a second embodiment, the area surrounding the exposed end of the rod (soil nail) is filled with shotcrete to form a wale beam. The end of the rod (soil nail) is then secured to this shotcrete wale beam with the bearing plate and fastener arrangement.

As shown by the above patents, the ultimate strength of a soil nail wall system depends entirely on the configuration and characteristics of the soil nails themselves. Thus, a large number of nails must be supplied to adequately support the entire width of the slope face. In addition, the soil nails must be of a sufficient length to support the slope wall to the ultimate depth of the entire excavation. Further, because the soil nails form a permanent part of the final retaining wall structure, they must be corrosion protected to resist long term deterioration. Accordingly, a large number of lengthy corrosion protected permanent soil nails are required to support an excavation with the prior art soil nailing methods. Thus, despite the fact that no timber lagging or sheet piles are necessary, the prior art soil nailing methods remain a costly alternative.

Tieback Element and Soil Nail Walls (TEN Walls)

The TEN wall is a combination of the above-described methods. A TEN wall is made up of a plurality of tiebacks, retaining wall elements and soil nails. This method utilizes short soil nails and pneumatically applied concrete to temporarily support a section of the soil wall to a certain depth. At some point of the excavation, when further support becomes necessary to retain the soil wall, a row of tiebacks is added. By using the soil nails and blown concrete as support between tiebacks, the wall uses both soil nails and tiebacks for support. Thus, tiebacks and shorter soil nails are required for the completed structure than in a wall built with either soil nails or tiebacks. This method consists of the following steps:

excavating a soil wall from the top down in successive sections;

applying a layer or layers of pneumatically applied concrete to help support the exposed face of the soil wall;

installing soil nails through the pneumatically applied concrete layer or layers and into the soil mass;

positioning retaining elements along the exposed face of the soil wall;

installing tiebacks through the retaining elements and into the soil mass;

testing and prestressing the tiebacks against the retaining elements; and repeating the above steps as needed.

In the above described TEN wall method, both the soil nails and the tiebacks form a part of the final retaining wall support structure. The ultimate strength of the retaining wall will depend entirely on the strength of the soil nails and tiebacks themselves. No further reinforcement to the retaining wall structure is provided.

Other Prior Art Retaining Wall Methods

Another prior art retaining wall method utilizes soil nails and a layer or layers of pneumatically applied concrete to temporarily support an excavated soil wall. Tiebacks are also installed, and a permanent outer concrete wall is poured and cured or attached. This method consists of the following steps:

excavating a soil wall from the top down in successive sections;

applying a layer or layers of pneumatically applied concrete to help support the exposed face;

installing soil nails through the pneumatically applied concrete layer or layers and into the soil mass;

installing tiebacks through the pneumatically applied concrete layer or layers and into the soil mass;

repeating the above steps as needed;

attaching or pouring and curing an outer layer of concrete; and testing and prestressing the tiebacks against the outer layer of concrete.

Of particular importance to this method is that the tiebacks are tested and prestressed against the final outer layer of poured concrete. Because the tiebacks are not tested and prestressed until the final outer wall is poured and cured, the tiebacks either visibly protrude through the completed wall or the wall must be patched at each tieback location. In either case the wall is unattractive.

U.S. Pat. No. 4,911,582 discloses a further prior art method which utilizes a concrete replacement wall to strengthen, repair or replace an existing earth retaining wall. In this method, tiebacks are installed through the exposed face and into the soil mass. Preferably, the tiebacks are installed in an open area of the existing wall which is filled with concrete. The tiebacks are then secured via an anchorhead assembly, and tested and prestressed against the existing wall. Finally, an outer concrete wall is cast in place over the entire exposed face of the wall. The outer wall is reinforced with a grid of reinforcing bars, which is positioned before the concrete wall is cast and which may intersect studs of a plurality of anchorhead assemblies. Alternatively, soil nails may be used instead of tiebacks. The method thus consists of the following steps:

installing tiebacks (or soil nails) through an existing retaining wall and into the soil mass;

testing and prestressing the tiebacks against the existing retaining wall; and pouring a concrete wall over the existing retaining wall and the exposed end of the tiebacks.

The above-described method is specifically designed for shoring up an existing retaining wall, not a newly formed embankment. Thus, this method does not provide for the temporary support of an excavated slope. Rather, because no excavation takes place, the method of U.S. Pat. No. 4,911,582 is directed solely to a concrete replacement wall which is designed to strengthen, repair or replace an existing earth retaining wall.

It can thus be seen that there is a need for an improved method of facing an excavated slope disposed beneath an existing bridge structure. So that the bridge need not be demolished, the method must be capable of adequately supporting an excavated embankment without the need for vertical piling. In addition, such a method must be designed to provide for the temporary support of a slope face as an excavation proceeds in a top to bottom manner. Further, the method should overcome the disadvantages inherent in existing prior art retaining wall systems by providing a structurally sound retaining wall which is attractive.

SUMMARY OF THE INVENTION

Accordingly, it is a principal object of the present invention to provide a novel method of shoring and facing an excavated slope with a retaining wall.

It is a further object of the present invention to provide a method of shoring an excavated slope which is designed to provide effectively for the temporary shoring up of a slope face as an excavation proceeds in a top to bottom manner.

It is a still further object of the present invention to provide such a method of temporarily shoring and permanently facing an excavated slope which results in a structurally sound and attractive retaining wall.

Finally, it is a more particular object of the present invention to provide a novel method of temporarily shoring and permanently facing an excavated slope with a retaining wall which can be used for embankments disposed adjacent to existing bridge structures.

Directed to achieving these objects, a novel method of temporarily shoring and permanently facing an excavated slope is herein provided. The method utilizes a "top down" technique for excavating the embankment material in sections. A temporary shoring wall is used to shore up the slope while the excavation proceeds downwardly. When the excavation is complete, an outer layer of concrete is attached to the temporary shoring wall and a final retaining wall is thereby formed.

First, an embankment is excavated from the top down. Material is removed in sections to form exposed slope faces. Temporary support is provided by shoring up the exposed slope face of each successively excavated section with soil nails and at least one layer of pneumatically applied concrete. Suitable pneumatically applied concrete is shotcrete or gunite. Excavation continues in descending stages with the soil nails and pneumatically applied concrete forming a temporary shoring wall along the exposed slope face of the batter or vertical embankment.

When the desired final depth of the excavation is reached, tiebacks are installed. One end of each tieback extends outwardly away from the exposed slope faces.

The pneumatically applied concrete is thickened along the exposed slope faces in the area of the tiebacks so as to form reinforcement elements. The reinforcement elements include reinforced steel bars which extend outwardly away from the exposed slope faces. The tiebacks are tested, prestressed and secured against the reinforcement elements.

A final retaining wall is then formed by attaching an outer layer of concrete to the temporary shoring wall. The reinforced steel bars protruding from the reinforcement elements serve to "tie" together the outer layer of concrete and the tiebacks.

In an alternative embodiment of the present invention, the tiebacks are installed at any time before the final depth of the excavation has been reached. In this embodiment, the soil nails provide all the required temporary support and the tiebacks are installed as the excavation proceeds downwardly. The tiebacks are similarly tested, prestressed and secured against the thickened pneumatically applied concrete reinforcement elements. Also similarly, a final retaining wall is formed in this embodiment by attaching an outer layer of concrete to the temporary shoring wall, and reinforced steel bars protrude from the reinforcement elements to "tie" together the outer layer of concrete and the tiebacks.

Notably, with the above-described method the final retaining wall consists only of the outer layer of reinforced concrete, the tiebacks, the reinforced elements and the reinforced steel bars. The soil nails provide only temporary support to the successively excavated sections and do not provide permanent support to the final retaining wall.

The present invention thus overcomes many of the disadvantages of the prior art retaining wall methods. Initially, the present invention overcomes the disadvantages of the tied-back wall method because no vertical piling is required. By using soil nails and pneumatically applied concrete to temporarily shore up the embankment, the present method provides for the temporary support of excavated sections without using vertical piling. Thus, the method of the present invention may be used to face excavations beneath existing bridge structures without requiring the demolition of a portion of the bridge structure itself.

Similarly, the present invention overcomes the disadvantages associated with soil nail walls. In the prior art soil nailing methods, the soil nails are used to permanently support the embankment. These soil nails are specifically designed to contribute to the ultimate strength of the final retaining wall, and protrude outwardly from the exposed face of the temporary retaining wall structure to receive a fastening element. Thus, the soil nails of the prior art method must be of a sufficient length to support the entire embankment, must be corrosion protected, and must also be specially adapted to receive a fastening element. By contrast, the soil nails of the present invention are merely used to temporarily support successive sections of the excavation as it proceeds downwardly. Thus, unlike the prior art methods, the temporary soil nails of the present invention provide no permanent support to the final retaining wall structure. Accordingly, the temporary soil nails of the present invention need not be corrosion protected. Further, the temporary soil nails of the present invention need not be of a great length. Those soil nails required for the temporary support of exposed slope face sections need only be of a sufficient length to support the slope wall temporarily until the concrete facing is poured and thus structurally connected to the tiebacks. The present invention is thus more cost effective than the prior art soil nailing techniques because temporary soil nails which are shorter and not corrosion protected may be used.

The present invention overcomes similar disadvantages associated with the prior art TEN wall method. With the TEN wall, both the soil nails and the tiebacks form a part of the final retaining wall support structure. In the present invention, the soil nails do not provide support to the completed structural wall. When complete, it is the tiebacks and the attached outer layer of concrete that ultimately support the excavated slope. The soil nails are merely used in conjunction with the pneumatically applied concrete skin to temporarily shore up the soil wall as the excavation proceeds downwardly. The permanent strength of the wall comes entirely from the tiebacks in conjunction with the attached outer layer of concrete.

As discussed above, the method of U.S. Pat. No. 4,911,582 is specifically designed for use with an existing retaining wall. Hence, since no excavation is done, this patent does not provide for the temporary support of an excavated slope. The method of the present invention, on the other hand, may be readily used with a newly excavated slope. The present method specifically provides for the temporary support of a slope face as an excavation proceeds downwardly.

In the remaining retaining wall method discussed above, the tiebacks are tested and prestressed against the final outer concrete wall. Thus, the ends of the tiebacks visibly protrude through the completed wall. The present invention, on the other hand, installs pneumatically applied concrete reinforcing elements, so that each tieback can be tested and prestressed before the final outer wall is poured and cured or attached. In this manner, the tiebacks of the present invention are thus not visible in the completed retaining wall structure.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DETAILED DESCRIPTION OF THE INVENTION

The present invention is directed to a method of facing an excavated slope with a retaining wall. The method utilizes a "top down" technique for excavating the soil material in sections, and is particularly adapted for use with embankments located beneath existing bridge structures.

Figure 1:
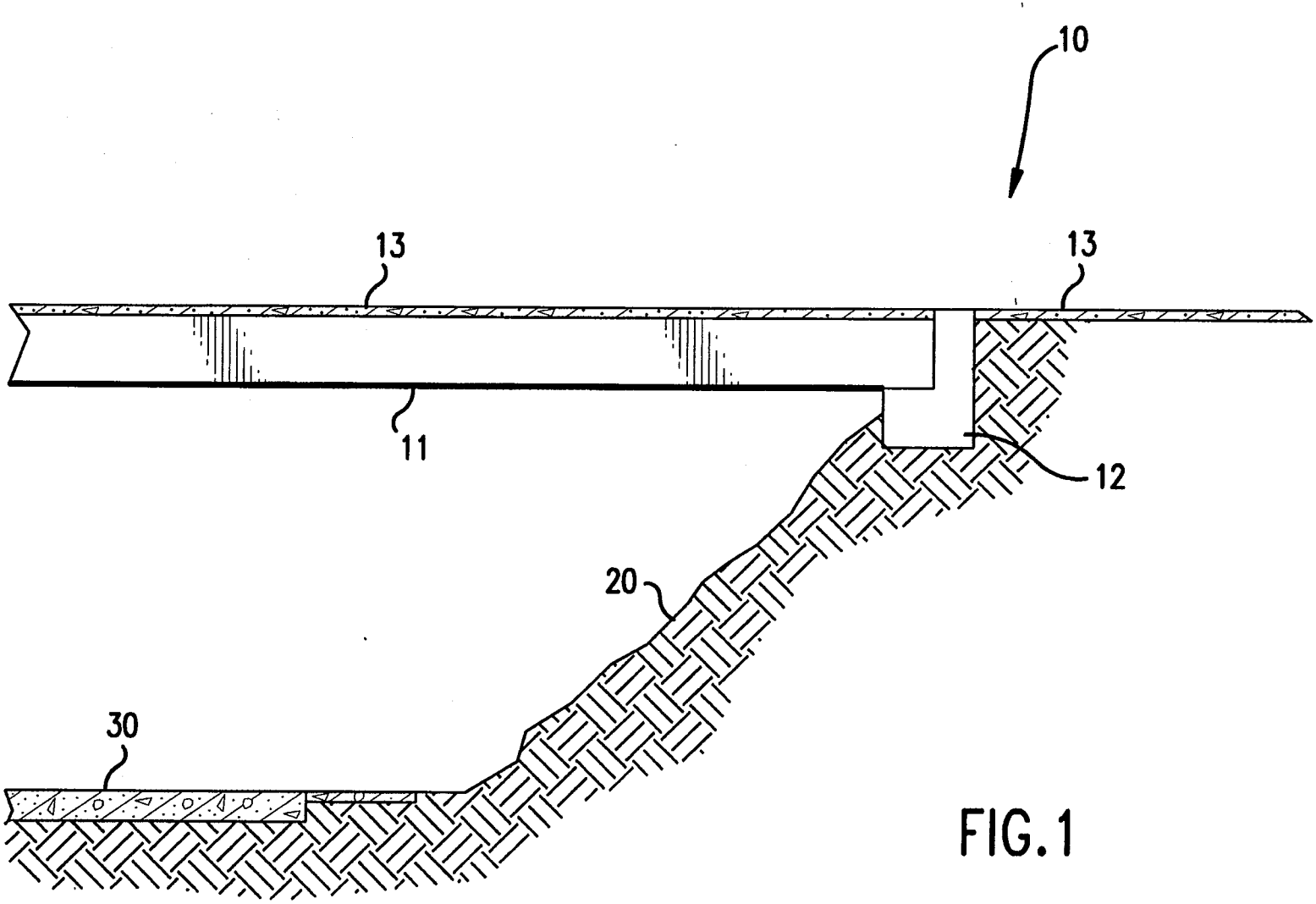
FIG. 1 is a sectional view of a typical highway bridge structure, supporting embankment and lower roadway surface.

A typical highway bridge construction is shown in FIG. 1. The bridge structure (10) is made up of girders (11) which extend along the length of the bridge and terminate in abutments (12). The abutments (12) rest upon an embankment (20) provided at each end of the bridge support structure or alternatively on piling. The embankment (20) is comprised of earthen soil, rock, gravel, a combination of those materials, or any other material suitable for supporting a bridge structure. The area above the bridge structure (10) is typically used as an upper roadway surface (13), and a lower roadway surface (30) is ordinarily disposed adjacent to the embankment (20) running beneath the bridge span.

Figure 2:
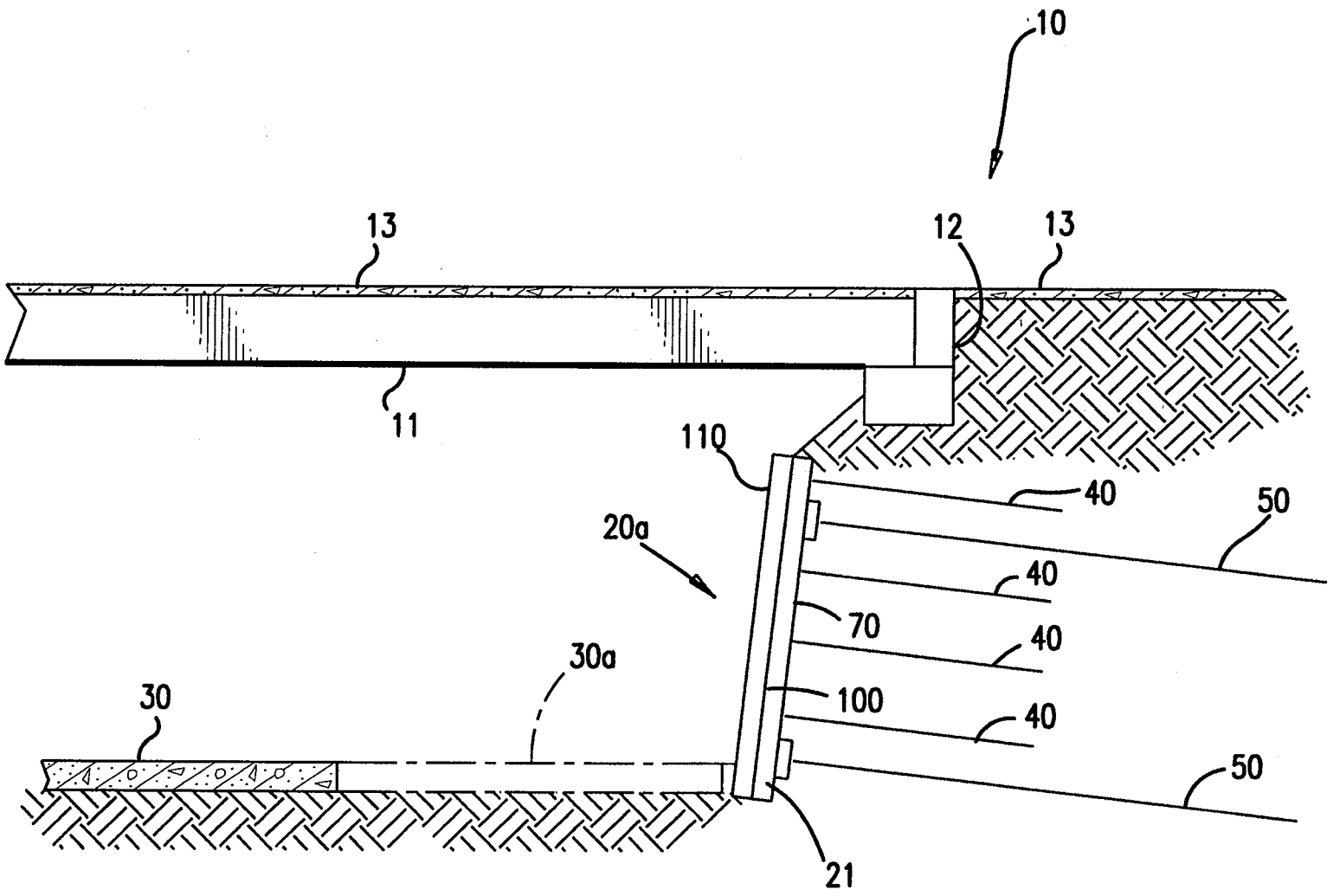
FIG. 2 is a sectional view of a typical highway bridge structure incorporating the method of the present invention for shoring and facing the excavated embankment alongside a widened roadway surface.
Figure 3:
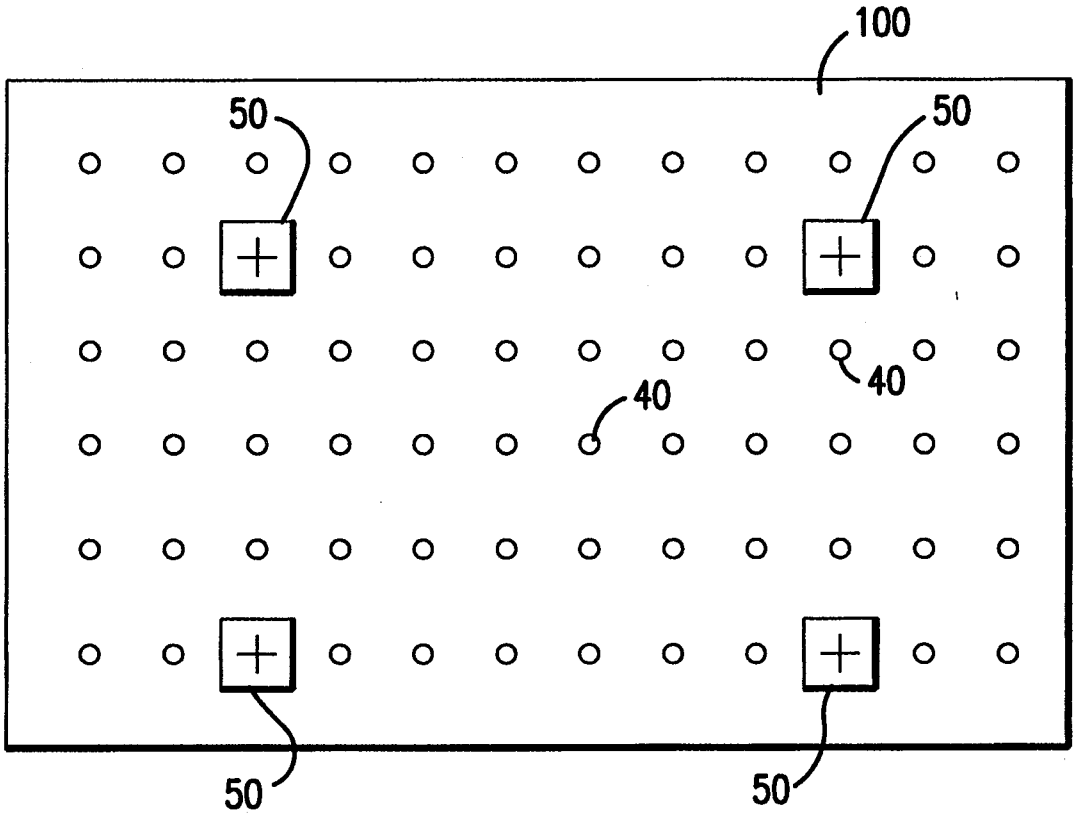
FIG. 3 is a partially broken away view of the embankment as seen laterally along the excavation and showing the soil nails and the tiebacks of the method of the present invention.
Figure 4:
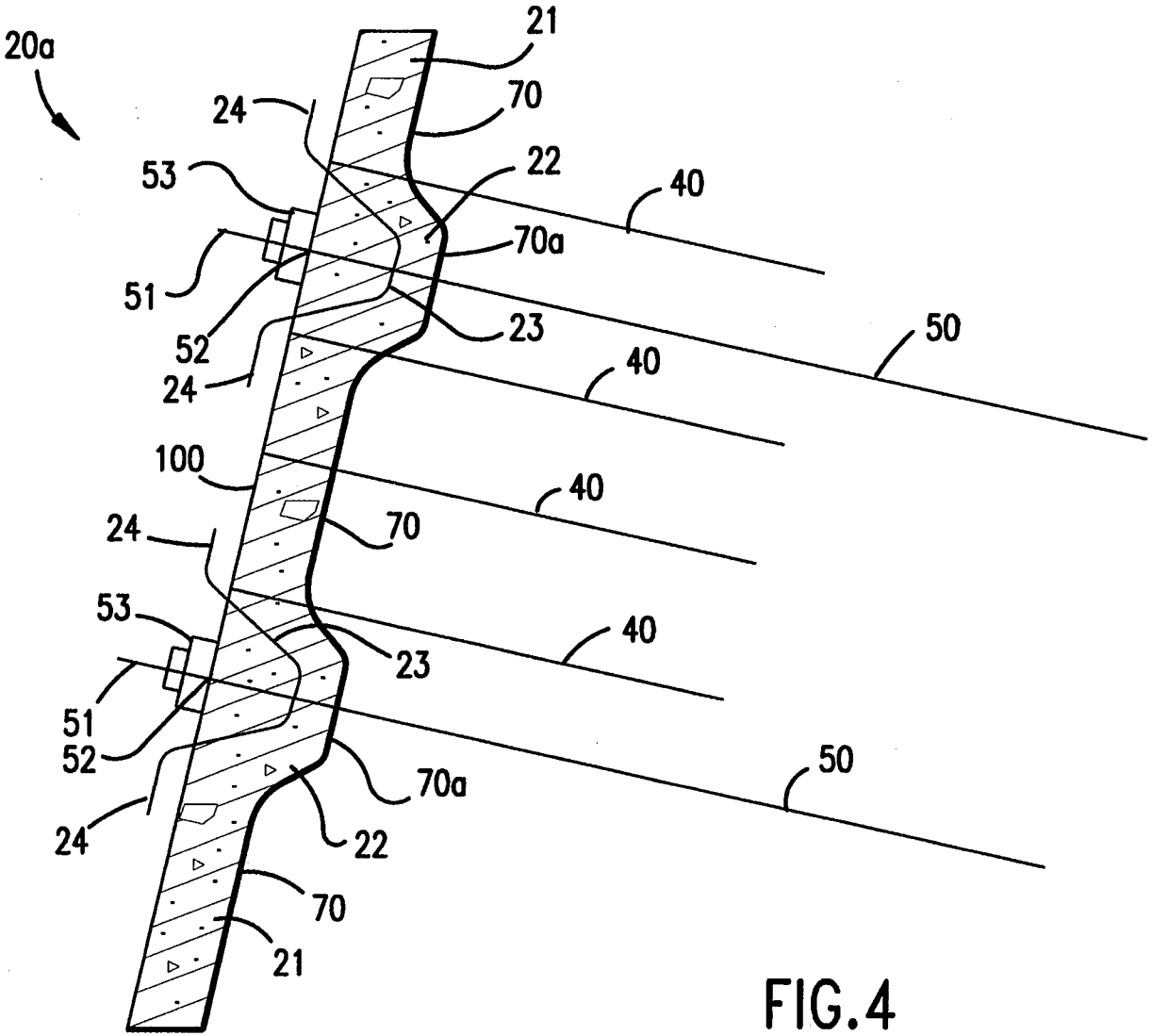
FIGS. 4 and 5 are sectional views illustrating the steps of the method of shoring and facing a newly excavated slope in accordance with the present invention.

It is often necessary to excavate the slope or embankment (20) beneath the bridge structure (10). For example, as shown in FIG. 2, when the second roadway surface (30) beneath the bridge (10) is widened (at 30*a*), the embankment (20) must be re-excavated (to 20*a*) to make room beneath the bridge for the expanded roadway surface (30, 30*a*). Subsequently, the newly formed slope of the embankment (20*a*) must be sufficiently retained so that the earth is retained permanently.

The method of the present invention is designed to achieve this result in the following manner. A "top down" technique is used to excavate the existing embankment material. The excavation begins along the top of the existing slope and proceeds downwardly until the desired final depth is reached. The embankment material is removed in sections to form exposed slope faces of a new slope wall (70). Temporary support is provided by shoring up the exposed slope face of each successively excavated section with soil nails (40) and at least one layer of pneumatically applied concrete (21). Excavation continues in descending stages with the soil nails (40) and pneumatically applied concrete (21) forming a temporary shoring wall (100) along the newly exposed slope wall (70) of the batter or vertical embankment.

More particularly, the outer face of each completed section of the new slope wall (70) is temporarily shored with an outer "skin" (21) and temporary soil nails (40). The "skin" (21) is formed by one or more layers of pneumatically applied concrete sprayed over the entire face of the newly formed slope (70). This concrete skin may be provided to any suitable depth, e.g. to a depth of 4 inches, depending upon the soil condition of the slope wall. Suitable commercially available pneumatically applied concrete materials are shotcrete or gunite. The soil nails (40) are inserted through the skin of pneumatically applied concrete (21) and into the embankment material in a conventional manner to provide support and stabilization. As the excavation proceeds downwardly, each successive section similarly receives temporary shoring from the pneumatically applied concrete skin (21) and the temporary soil nails (40). A temporary shoring wall (100) is thus formed.

Because the soil nails (40) are used only to temporarily shore up the newly exposed slope face, conventional steel rods may be used. These soil nails or rods (40) need only be of a length sufficient to support the depth of the newly excavated section. Further, since these soil nails (40) will not provide permanent support to the excavated slope wall, the soil nails (40) need not be corrosion protected. Rather, with the method of the present invention it is entirely acceptable for the temporary soil nails (40) to deteriorate over time once the completed retaining wall structure is in place.

When the desired final depth of the excavation is reached, tiebacks (50) are installed. The tiebacks (50) are installed through the pneumatically applied concrete skin (21) and into the embankment material at predetermined locations along the slope wall. The pneumatically applied concrete skin (21) is thickened at these locations (70*a*) to form a reinforcement element or "pad" (22). The pads (22) may be formed in an area (70*a*) which is excavated to a depth greater than the remainder of the newly formed slope wall (70). Each tieback (50) extends through the respective pad (22) and outwardly away from the face of the slope wall. The exposed end (51) includes a fastening means (52), such as screw threads, for securing a tieback (50) against the pneumatically applied concrete pad (22). The tiebacks (50) are tested and tensioned against the pad-like area (22) of thickened pneumatically applied concrete. In this manner, the tiebacks (50) provide the calculated strength to fully resist the earth pressures.

Figure 5:
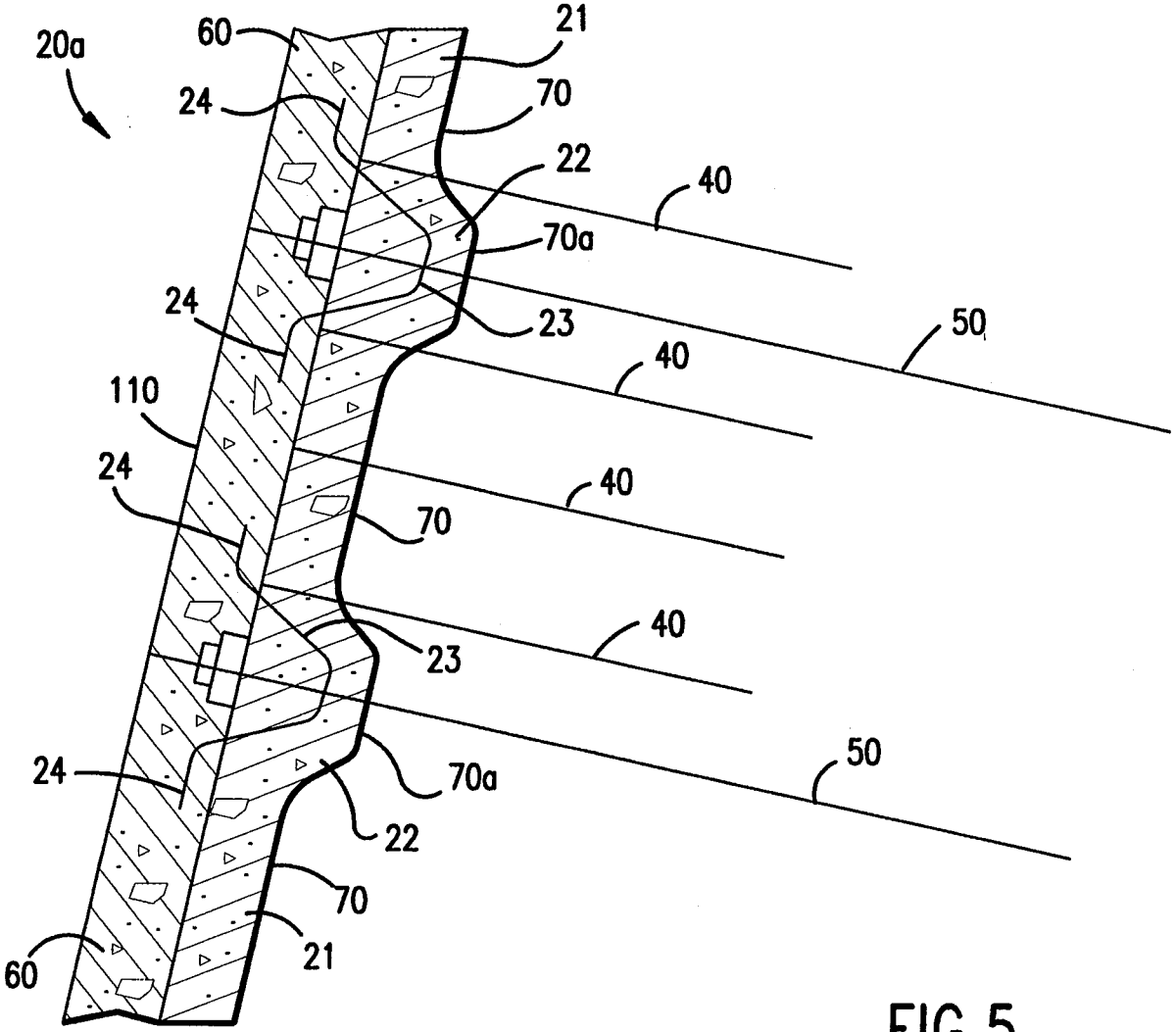

As shown in FIGS. 5 and 6, conventional bent reinforced steel bars (23) extends throughout the pneumatically applied concrete pads (22). Further, exposed ends (24) of this reinforced steel (23) protrude outwardly away from the pads (22) and the face of the slope wall. As discussed more fully below, this reinforced steel (23) is an important feature of the completed retaining wall structure.

Finally, when the last section of embankment material is excavated at the desired final depth, an outer layer of concrete (60) is added along the outermost surface of the pneumatically applied concrete skin (21). This outer concrete layer is preferably poured and cured in-situ. The outer concrete layer (60) covers the exposed face of the temporary retaining wall (100) and the protruding ends of the tiebacks (50). Most importantly, the outer concrete layer (60) "ties" to the exposed ends (24) of the reinforced steel (23) protruding from the pneumatically applied concrete pads (22). In this manner, a final permanent retaining wall (110) is provided consisting of the integrally joined outer concrete layer (60) and the tiebacks. The thusly formed final permanent retaining wall (110) is capable of sufficiently retaining the earth pressures which act on it.

Contrary to prior art retaining wall structures, with the above-described method no vertical piling is used to temporarily support the slope wall as the excavation proceeds downwardly. Rather, the present invention utilizes pneumatically applied concrete (21) and soil nails (40) to provide temporary support to the slope wall. Thus, because no vertical drilling is required, the method of the present invention may be used to excavate embankments located beneath bridges without disturbing any existing structure.

Further contrary to prior art methods, the temporary soil nails (40) of the present invention do not provide permanent support to the completed structural wall. When complete, it is the tiebacks (50) in conjunction with the outer poured concrete wall (60) that support the newly excavated slope (70). Thus, unlike with prior art methods, the temporary soil nails need not be of a great length, corrosion protected, or specially adapted to receive a fastening element. Nonetheless, the temporary soil nails (40) serve an important function in the excavation and formation of the retaining wall structure. The temporary soil nails (40) are used to temporarily support the slope wall as the excavation proceeds downwardly, i.e. the soil nails (40) are spaced about the slope wall of a particular section to provide, along with the pneumatically applied concrete, temporary support to the newly excavated area.

In an alternative embodiment of the present invention, the tiebacks (50) may be installed before the final depth of the excavation has been reached. In this embodiment, the tiebacks (50) are installed as the excavation proceeds downwardly when further shoring up of the exposed slope face sections becomes necessary. This embodiment of the method of the present invention may be suitable for certain soil conditions. The tiebacks (50) are similarly tested, prestressed and secured against the thickened pneumatically applied concrete reinforcement elements (22). Also similarly, a final permanent retaining wall (110) is formed in this embodiment by attaching an outer layer of concrete (60) to the temporary shoring wall (100), and reinforced steel bars (23) protrude from the reinforcement elements to "tie" together the outer layer of concrete (60) and the tiebacks (50).

A retaining wall utilizing the method of the present invention is typically built of a multiplicity of short walls, each of which is structurally complete. The reinforced wall (60) is designed to span between tiebacks both horizontally and vertically. Typically this will result in each increment being about 25 or 30 feet long, as high as required, and about a foot thick. Each increment is capable of retaining the earth pressure which acts on it. The completed wall contains as many increments as required by the bridge geometry.

Preferably, the final retaining wall in the above-described method will be only slightly sloped as shown in FIGS. 2 and 5. However, the method of the present invention is also suited for use with entirely vertical retaining walls.

Further, each of the various structural materials employed in the final permanent retaining wall should be treated to prevent long term deterioration. For example, the tiebacks (50) and reinforced steel bars (23) may be chemically treated to resist corrosion.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A method of temporarily shoring and permanently facing an excavated slope comprising the following steps:

excavating a slope in successive sections to form exposed slope faces;

forming a temporary shoring wall by shoring up the exposed slope face of each successively excavated section with temporary soil nails and at least one layer of pneumatically applied concrete, thickening said at least one layer of pneumatically applied concrete to form reinforcement elements, said reinforcement elements including reinforced steel bars which extend outwardly away from said exposed slope faces, installing tiebacks through said reinforcement elements and testing, tensioning and securing said tie backs against said reinforcement elements; and forming a final retaining wall by placing an outer layer of reinforced concrete over said temporary shoring wall and tensioned tiebacks, such that the outer layer of concrete ties to the tiebacks via the reinforced steel bars and the final retaining wall is fully supported by the tiebacks through the reinforcement elements and the reinforced steel bars.

2. The method of temporarily shoring and permanently facing an excavated slope as in claim 1 wherein said outer layer of reinforced concrete is poured and cured in-situ.

3. The method of temporarily shoring and permanently facing an excavated slope as in claim 1 wherein said pneumatically applied concrete is shotcrete.

4. The method of temporarily shoring and permanently facing an excavated slope as in claim 1 wherein said pneumatically applied concrete is gunite.

5. The method of temporarily shoring and permanently facing an excavated slope as in claim 1 wherein said tiebacks are installed after the slope is excavated to a final depth.

6. The method of temporarily shoring and permanently facing an excavated slope as in claim 1 wherein said thickened concrete reinforcement elements are formed by excavating a hole into the slope within which each thickened concrete reinforcement element is formed.

7. The method of temporarily shoring and permanently facing an excavated slope as in claim 6 wherein said reinforced steel bars are installed by extending an interior portion of the bars into the thickened concrete disposed in the excavated hole and extending an exterior portion of the bars outward from the face of the thickened concrete.

8. A method of temporarily shoring and permanently facing an excavated slope under an existing bridge structure comprising the following steps:

excavating a slope beneath the existing bridge structure in successive sections to form exposed slope faces;

forming a temporary shoring wall beneath the existing bridge structure by shoring up the exposed slope face of each successively excavated section with temporary soil nails and at least one layer of pneumatically applied concrete, thickening said at least one layer of pneumatically applied concrete to form reinforcement elements, said reinforcement elements including reinforced steel bars which extend outwardly away from said exposed slope faces, installing tieback through said reinforcement elements and testing, tensioning and securing said tie backs against said reinforcement elements; and forming a final retaining wall beneath the existing bridge structure by placing an outer layer of reinforced concrete over said temporary shoring wall and tensioned tieback, such that the outer layer of concrete ties to the tieback via the reinforced steel bars and the final retaining wall is fully supported by the tiebacks through the reinforcement elements and the reinforced steel bars.

9. The method of temporarily shoring and permanently facing an excavated slope as in claim 8 wherein said outer layer of reinforced concrete is poured and cured in-situ.

10. The method of temporarily shoring and permanently facing an excavated slope as in claim 8 wherein said pneumatically applied concrete is shotcrete.

11. The method of temporarily shoring and permanently facing an excavated slope as in claim 8 wherein said pneumatically applied concrete is gunite.

12. The method of temporarily shoring and permanently facing an excavated slope as in claim 8 wherein said tiebacks are installed after the slope is excavated to a final depth.

13. The method of temporarily shoring and permanently facing an excavated slope as in claim 8 wherein said thickened concrete reinforcement elements are formed by excavating a hole into the slope within which each thickened concrete reinforcement element is formed.

14. The method of temporarily shoring and permanently facing an excavated slope as in claim 13 wherein said reinforced steel bars are installed by extending an interior portion of the bars into the thickened concrete disposed in the excavated hole and extending an exterior portion of the bars outward from the face of the thickened concrete.

* * * * *

UNITED STATES PATENT AND TRADEMARK OFFICE

CERTIFICATE OF CORRECTION

PATENT NO. : 5,395,185
DATED : March 7, 1995
INVENTOR(S) : Harry Schnabel, Jr.

It is certified that error appears in the above-indentified patent and that said Letters Patent is hereby corrected as shown below:

On the title page, item [54] and column 1, line 3, change "AND" (second occurrence) to --AN--.

Column 1, line 9, delete "dirty" and insert therefore --directed--;

Column 1, lines 11 and 23, delete "reining" and insert therefore --retaining--;

Column 2, line 35, delete "beating" and insert therefore --bearing--;

and

Column 10, lines 55, 62 and 63, delete "tieback" and insert therefore --tiebacks--.

Signed and Sealed this

Twenty-third Day of May, 1995

*Attest:*

*Attesting Officer*

BRUCE LEHMAN

*Commissioner of Patents and Trademarks*